US010704830B2

(12) United States Patent
Atapattu et al.

(10) Patent No.: US 10,704,830 B2
(45) Date of Patent: Jul. 7, 2020

(54) PROCESS AND SYSTEM FOR RELIQUEFYING BOIL-OFF GAS (BOG)

(71) Applicant: Gas Technology Development Pte Ltd, Singapore (SG)

(72) Inventors: Ravindu Atapattu, Singapore (SG); Erine Siew Pheng Teh, Singapore (SG); Kok Seng Foo, Singapore (SG)

(73) Assignee: Gas Technology Development Pte Ltd, Singapore (SG)

( * ) Notice: Subject to any disclaimer, the term of this patent is extended or adjusted under 35 U.S.C. 154(b) by 206 days.

(21) Appl. No.: 15/947,861

(22) Filed: Apr. 8, 2018

(65) Prior Publication Data

US 2019/0226758 A1 Jul. 25, 2019

(30) Foreign Application Priority Data

Jan. 24, 2018 (SG) ..... 10201800642P

(51) Int. Cl.

| | |
|---|---|
| ***F25J 1/00*** | (2006.01) |
| ***F17C 9/04*** | (2006.01) |
| ***F25J 1/02*** | (2006.01) |

(52) U.S. Cl.

CPC ..... *F25J 1/0025* (2013.01); *F17C 9/04* (2013.01); *F25J 1/004* (2013.01); *F25J 1/0037* (2013.01); *F25J 1/0045* (2013.01); *F25J 1/0202* (2013.01); *F25J 1/023* (2013.01); *F25J 1/0221* (2013.01); *F25J 1/0224* (2013.01); *F25J 1/0277* (2013.01); *F25J 1/0296* (2013.01); *F17C 2265/034* (2013.01); *F25J 2210/62* (2013.01); *F25J 2235/02* (2013.01); *F25J 2235/60* (2013.01); *F25J 2290/62* (2013.01)

(58) Field of Classification Search

CPC ..... F25J 1/0025; F25J 1/0277; F25J 1/0296; F25J 1/023; F25J 1/0202; F25J 1/0045; F25J 1/0221; F25J 1/0224; F25J 1/004; F25J 1/0037; F25J 2210/62; F25J 2290/62; F25J 2235/02; F25J 2235/60; F17C 9/04; F17C 2265/034

See application file for complete search history.

(56) References Cited

U.S. PATENT DOCUMENTS

| | | | | |
|---|---|---|---|---|
| 2,959,928 A * | 11/1960 | Maker | ..... | F25J 1/0277 62/47.1 |
| 3,857,245 A | 12/1974 | Jones | | |
| 3,874,185 A | 4/1975 | Etzbach | | |

(Continued)

FOREIGN PATENT DOCUMENTS

| | | | |
|---|---|---|---|
| JP | 2017-089606 | A | 5/2017 |
| KR | 10-2015-0033279 | A | 4/2015 |

OTHER PUBLICATIONS

Search Report and Written Opinion of Singapore patent application No. 10201802888Q dated Feb. 18, 2019 (9 pages).

(Continued)

*Primary Examiner* — Ljiljana V. Ciric
(74) *Attorney, Agent, or Firm* — Pyprus Pte Ltd

(57) ABSTRACT

A reliquefaction system and process for innovative reliquefaction of LNG boil-off gas (BOG), where the reliquefaction is propelled by LNG gas fuel. The reliquefaction system is preferably installed on shipboard including LNG carrier or harbor tug, where the LNG carrier and harbor tug use a gas fuel engine.

7 Claims, 3 Drawing Sheets

(56) References Cited

U.S. PATENT DOCUMENTS 4,727,723 A * 3/1988 Durr ..... F25J 1/0022 62/48.2
6,070,429 A * 6/2000 Low ..... F25J 1/0022 62/612
6,658,890 B1 * 12/2003 Hahn ..... F25J 1/004 62/611
8,739,569 B2 6/2014 Oka et al.
8,893,515 B2 * 11/2014 Mak ..... F25J 1/0204 62/48.2
2008/0066493 A1 * 3/2008 Buijs ..... F25J 3/0209 62/620
2010/0011663 A1 * 1/2010 Coyle ..... F25J 1/0245 48/127.3
2010/0175425 A1 * 7/2010 Walther ..... F25J 1/0022 62/623
2011/0056238 A1 * 3/2011 Mak ..... F17C 9/04 62/614
2012/0047943 A1 * 3/2012 Barclay ..... F25J 1/004 62/613
2012/0240600 A1 * 9/2012 Paulus ..... F17C 1/002 62/48.2
2012/0289407 A1 * 11/2012 Nelson ..... F25J 1/0208 505/163
2015/0013379 A1 * 1/2015 Oelfke ..... F25J 1/0022 62/612
2015/0253070 A1 * 9/2015 Davies ..... F25J 1/0022 62/614
2015/0285553 A1 * 10/2015 Oelfke ..... F25J 1/0022 62/611
2015/0308736 A1 * 10/2015 Chen ..... F25J 1/0212 62/623
2015/0308737 A1 * 10/2015 Chen ..... F25J 3/061 62/623
2015/0308738 A1 * 10/2015 Ott ..... F25J 3/0209 62/623
2015/0316316 A1 * 11/2015 Oelfke ..... F25J 1/0292 62/611
2015/0330574 A1 11/2015 Fuchs et al.
2018/0180355 A1 * 6/2018 Ladd ..... F25J 1/0087
2018/0259251 A1 * 9/2018 Poorte ..... F25J 3/061
2018/0347901 A1 * 12/2018 Groenendijk ..... F25J 1/004
2019/0056174 A1 * 2/2019 Ragot ..... F25J 1/0279

OTHER PUBLICATIONS

Second Written Opinion of Singapore patent application No. 10201802888Q dated Oct. 18, 2019 (4 pages).
Notice of Preliminary Rejection of Korean patent application No. 10-2018-0054334 dated Nov. 25, 2019 (6 pages).
Extended European Search Report of European patent application No. 18166200.8 dated Oct. 31, 2018 (10 pages).

* cited by examiner

PROCESS AND SYSTEM FOR RELIQUEFYING BOIL-OFF GAS (BOG)

FIELD OF THE INVENTION

The present invention relates to a process and system for reliquefaction of boil-off gas (BOG); the process and system are preferably suitable for being used onboard LNG carrier or harbor tug, which comprises a gas fuel engine.

BACKGROUND OF THE INVENTION

In recent years, the emission control regulations imposed by various regulatory bodies make LNG an attractive marine fuel and substitute for diesel powered onshore power plants; thus, demand for LNG bunker barges and small scale (break-bulk) LNG carriers has been increased significantly. In addition, due to widening of Emission Control Areas (ECAs) and implementation of 0.5% Sulphur cap limits by 1 Jan. 2020, LNG becomes an attractive fuel alternative for harbor vessels including tugs.

All these ocean-going LNG fueled carriers or harbor tugs contain either LNG cargo containment system, or LNG fuel tank to supply natural gas fuel for propulsion and other onboard electricity demand. Heat ingress into the cargo containment system or LNG fuel tank vaporizes some of the liquid to generate boil-off gas (BOG), which eventually increases the tank pressure. Regulations prohibit venting of excess BOG and marine class societies have mandated to have shipboard BOG management system. Onboard consumption of BOG as ship fuel is not an ideal solution since it could lead to deteriorate the original Wobbe index of the cargo as BOG is rich with nitrogen comparing to the LNG cargo composition. Thermal oxidation of the excess BOG is one of the available options, but it would be the costliest alternative.

Reliquefaction of BOG will overcome the above-mentioned issues. U.S. Pat. No. 3,874,185 discloses one conventional approach that it utilizes a closed loop nitrogen refrigeration. The problem with this conventional approach is that it requires large reliquefaction plant comprising a compressor and expander, which leads to higher capital cost and larger footprint.

U.S. Pat. No. 8,739,569 teaches a process to address the problems associated with Brayton cycle, which also utilizes nitrogen as a refrigerant. Instead of Brayton cycle, it introduces a plurality of pulse-tube refrigerators with secondary—refrigerant, to condensate BOG by vaporizing the liquid nitrogen (secondary refrigerant). A pulse tube refrigerator could be smaller than conventional Brayton cycle, but it is not a cost-effective approach due to the number of refrigerators required to perform the same thermal duty.

U.S. Pat. No. 3,857,245 describes another approach by utilizing the natural gas as a working fluid operate in an open cycle. In this process, partially condensed BOG can be obtained with typically 30 percent of liquid phase formation. This could be the simplest form of BOG reliquefaction (partial) system, but the remaining 60 to 70 percent of non-condensed BOG has to be sent to a burner for combustion. It makes the system inefficient and limiting the application on shipboard vessels.

SUMMARY OF THE INVENTION

The present invention provides a boil-off gas (BOG) reliquefaction system. In one embodiment, the BOG reliquefaction system comprises an in-tank fuel pump 1; a LNG storage tank 2; a heat exchanger 3; a multistage compressor 4; a compressor after cooler 5; an expansion valve 6; and a LNG flash drum 7; wherein the in-tank fuel pump 1 is disposed inside the LNG storage tank 2 for drawing LNG from the LNG storage tank 2; wherein the heat exchanger 3 is fluidly coupled with the in-tank fuel pump 1 for receiving the LNG from the in-tank pump 1 and coupled with the storage tank 2 to receive BOG from the storage tank 2; wherein the LNG is vaporized, and the vaporized LNG and the BOG provide cold sources, resulting in cold energy recovered BOG; wherein the inlet of the multistage compressor 4 is coupled to the heat exchanger 3 to receive the cold energy recovered BOG, and the outlet of the multistage compressor 4 to the inlet of the compressor after cooler 5; wherein the cold energy recovered BOG is compressed; and wherein the compressor after cooler 5 removes heat from the compressed BOG; wherein the outlet of the compressor after cooler 5 is coupled with the heat exchanger 3; and wherein the compressor after cooler 5 discharges the compressed and after cooled BOG to the heat exchanger 3 at a temperature ranging from 20° C. to 45° C.; wherein inside the heat exchanger, the compressed and after cooled BOG is cooled down further by the cold sources from the vaporized LNG and BOG; wherein the inlet of the expansion valve 6 is coupled with the heat exchanger 3 to receive the cryogenically cooled compressed BOG; wherein the outlet of the expansion valve 6 is coupled with the flash drum 7; wherein the cold compressed BOG is expanded via the expansion valve 6, resulting in the expanded BOG that is close to atmospheric pressure; and wherein the flash drum 7 receives the expanded BOG, and returns flash gas and LNG recovered to the LNG storage tank 2.

In another embodiment of the BOG reliquefaction system, the BOG is compressed in the multistage compressor 4 to a pressure ranges from 30 to 300 barg.

In another embodiment of the BOG reliquefaction system, the resultant cold compressed BOG leaves the heat exchanger at a temperature ranges from −130° C. to −155° C., preferably around −150° C.

In another embodiment, the BOG reliquefaction system further comprises a LNG booster pump 18, wherein the LNG booster pump 18 is disposed between the LNG storage tank 2 and the heat exchanger 3, and increases the pressure of the LNG to supply high-pressure fuel gas.

In another embodiment, the BOG reliquefaction system further comprises an additional vaporizer 20, wherein the vaporizer 20 is disposed downstream of the heat exchanger 3.

In another embodiment of the BOG reliquefaction system, the discharge cooling medium from the compressor after cooler 5 is used to heat the vaporizer 20.

In another embodiment of the BOG reliquefaction system, the expansion valve 6 is a Joule Thomson (JT) valve.

The present invention also provides a process of reliquefaction of LNG boil-off gas (BOG) 500. In one embodiment, the process comprises providing 510 cold BOG from a LNG storage tank, wherein the cold BOG is at close to atmospheric pressure and −160° C.; supplying 520 cold sources by passing cold LNG and the cold BOG through a heat exchanger, wherein the cold LNG is at close to atmospheric pressure and −160° C. and from the LNG storage tank; wherein the cold BOG is heated in the heat exchanger to room temperature, and the LNG is vaporized in the process; compressing 530 the heated BOG from the heat exchanger to a pressure ranges from 30 to 300 barg, wherein the compressed BOG is discharged with temperature ranging from 100 to 150° C.; cooling 540 the compressed BOG to remove heat from the compressed BOG, resulting in a cooled compressed BOG at a temperature ranging from 20° C. to 45° C.; further cooling 550 the cooled compressed BOG to a temperature ranging from −130° C. to −155° C., preferably around −150° C.; expanding 560 the further cooled compressed BOG into flash gas and LNG close to atmospheric pressure and −160° C.; and returning 570 the flash gas and LNG to the storage tank.

The objectives and advantages of the claimed subject matter will become apparent from the following detailed description of preferred embodiments thereof in connection with the accompanying drawings.

BRIEF DESCRIPTION OF THE DRAWINGS

Preferred embodiments according to the present invention will now be described with reference to the Figures, in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides a reliquefaction system and process for innovative reliquefaction of LNG boil-off gas (BOG), where the reliquefaction is propelled by LNG gas fuel. The reliquefaction system is preferably installed on shipboard including LNG carrier or harbor tug, where the LNG carrier and harbor tug use a gas fuel engine. The reliquefaction system and process of the present invention have many advantages including lower capital cost, smaller footprint, less equipment and lower weight, least complexity and lowest electrical consumption comparing to the reliquefaction systems available in the market.

Figure 1:
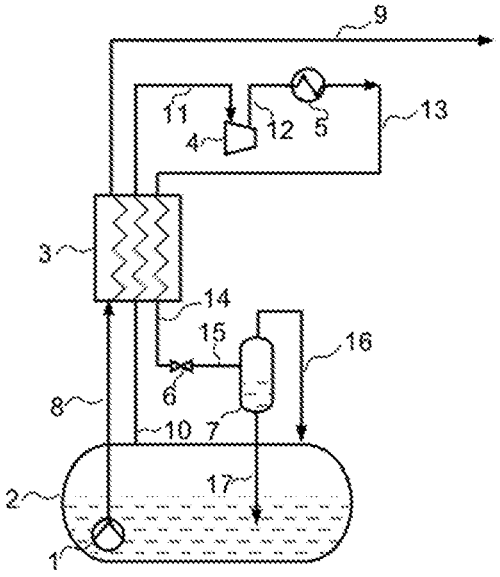
FIG. 1 is a schematic configuration of the BOG reliquefaction system in accordance with one embodiment of the present invention.

Referring now to FIG. 1, there is provided a BOG reliquefaction system in accordance with one embodiment of the present invention. It is preferable to use the BOG reliquefaction system onboard a LNG fuel ship comprising a low pressure gas fuel engine. As shown in FIG. 1, the reliquefaction system comprises: an in-tank fuel pump 1, a LNG storage tank 2, a heat exchanger 3, a multistage compressor 4, a compressor after cooler 5, an expansion valve 6, and a LNG flash drum 7.

The in-tank fuel pump 1 is disposed inside the LNG storage tank 2. In operation, in-tank fuel pump 1 draws LNG from the LNG storage tank 2.

The heat exchanger 3 is fluidly coupled with the in-tank fuel pump 1. The IN LNG stream 8 represents the LNG from the in-tank pump 1 to the heat exchanger 3, where the LNG is at close to atmospheric pressure and −160° C. Inside the heat exchanger 3, the LNG is fully vaporized and transfers its cold, and becomes superheated up to close to room temperature at the outlet of the heat exchanger 3, represented by the OUT LNG stream 9. In one embodiment, the heat exchanger 3 is a diffusion bonded heat exchanger. The source of heat comes from the compressed BOG, which will be described in more details hereinbelow.

The heat exchanger 3 is also fluidly coupled with the LNG storage tank 2 to receive BOG from the LNG storage tank 2, where the BOG is represented by the IN BOG stream 10. The IN BOG stream 10 is close to atmospheric pressure and at −160° C. when it is drawn from the LNG storage tank 2 into the heat exchanger 3. Inside the heat exchanger 3, the BOG transfers its cold, and becomes superheated up to close to room temperature at the outlet of the heat exchanger 3, represented by the OUT BOG stream 11.

The inlet of the multistage compressor 4 is coupled to the heat exchanger 3 to receive the cold energy recovered OUT BOG stream 11, and the outlet of the multistage compressor 4 to the inlet of the compressor after cooler 5. The outlet of the compressor after cooler 5 is coupled with the heat exchanger 3. When the low-pressure OUT BOG stream 11 is transported through the multistage compressor 4, the BOG is compressed in the multistage compressor 4 to a pressure ranges from 30 to 100 barg, preferably close to 50 barg for optimal efficiency and cost effectiveness in material and equipment selection. The compressed BOG is represented by the compressed BOG stream 12 and discharged with temperature of 100 to 150° C. to the compressor after cooler 5. The compressor after cooler 5 cools down the compressed BOG stream 12 and discharges the cool compressed BOG stream 13 to the heat exchanger 3. In certain embodiments, the temperature of the BOG stream 13 ranges from 20° C. to 45° C. depending upon the cooling medium such as cooling water, air cooler, etc. Inside the heat exchanger, the cool compressed BOG stream 13 is cooled down further by the cold sources from the IN LNG stream 8 and IN BOG stream 10, resulting in the cryogenically cooled compressed BOG stream 14. The resultant cryogenically cooled compressed BOG stream 14 leaves the heat exchanger at a temperature ranges from −130° C. to −155° C., preferably around −150° C.

The inlet of the expansion valve 6 is coupled with the heat exchanger to receive the cold compressed BOG stream 14. The outlet of the valve 6 is coupled with the flash drum 7. The cold compressed BOG stream 14 is expanded via the expansion valve 6, resulting in the expanded stream 15. The pressure of the expanded stream 15 is close to atmospheric pressure. In one embodiment, the expansion valve 6 is a Joule Thomson valve. The flash drum 7 receives the expanded stream 15. Inside the flash drum 7, some flash gas is formed and returned to the LNG storage tank 2 via the flash stream 16 with a temperature around −160° C. and near atmospheric pressure. The LNG recovered is returned to the LNG storage tank 2 via the RELIQUEFIED stream 17 with a temperature around −160° C. and near atmospheric pressure.

Figure 2:
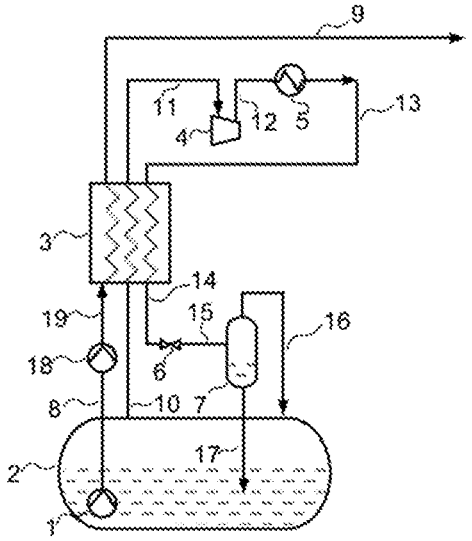
FIG. 2 is a schematic configuration of the BOG reliquefaction system in accordance with another embodiment of the present invention.

Referring now to FIG. 2, there is provided a BOG reliquefaction system in accordance with another embodiment of the present invention. It is preferable to use the BOG reliquefaction system onboard a LNG fuel ship comprising a high pressure gas fuel engine. The high pressure gas fuel engine can be a MEGI engine. As shown in FIG. 2, the reliquefaction system is similar to the one shown in FIG. 1 as described above, except that it further comprises a LNG booster pump 18, where the LNG booster pump 18 is disposed between the LNG storage tank 2 and the heat exchanger 3. When the in-tank fuel pump 1 draws the LNG from the storage tank 2, the IN LNG stream 8 is close to atmospheric pressure and −160° C. The LNG booster pump 18 increases the pressure of the LNG, resulting in the pressured LNG stream 19. At the discharge of the LNG booster pump 18, the pressured LNG stream 19 carries LNG at a pressure of 300 barg into the heater exchanger 3. The fully vaporized LNG in the OUT LNG stream 9 will supply the required high-pressure fuel gas to the MEGI engine. The other streams and equipment in FIG. 2 are to operate in the same conditions and manners as described in FIG. 1.

Figure 3:
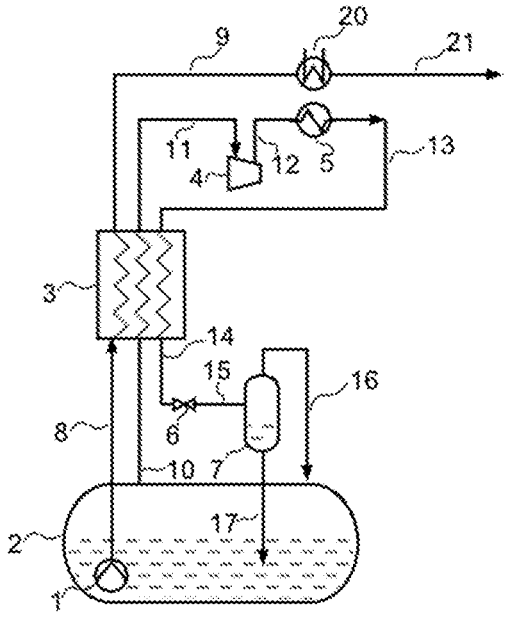
FIG. 3 is a schematic configuration of the BOG reliquefaction system in accordance with another embodiment of the present invention.

Referring now to FIG. 3, there is provided a BOG reliquefaction system including trim heater/vaporizer to produce gas fuel for high demand scenarios in accordance with another embodiment of the present invention. In this embodiment, the reliquefaction system acts as the main LNG fuel supply source, in parallel as a reliquefaction system. As shown in FIG. 3, the reliquefaction system is similar to the one shown in FIG. 1 as described above, except that it further comprises an additional vaporizer 20, where the vaporizer 20 is disposed downstream of the heat exchanger 3. In addition, the LNG booster pump 18 as shown in FIG. 2 can also be included if there is a need to supply high pressure fuel gas to an MEGI engine. The reliquefaction system as shown in FIG. 3 operates in the same conditions and with the same process flow as in FIG. 1 and FIG. 2 except that it has the capability of vaporizing LNG and superheating the LNG fuel stream 9 to the required temperature at around 50° C., represented by the stream 21. The vaporizer 20 can have hot water or steam as a heating medium.

Figure 4:
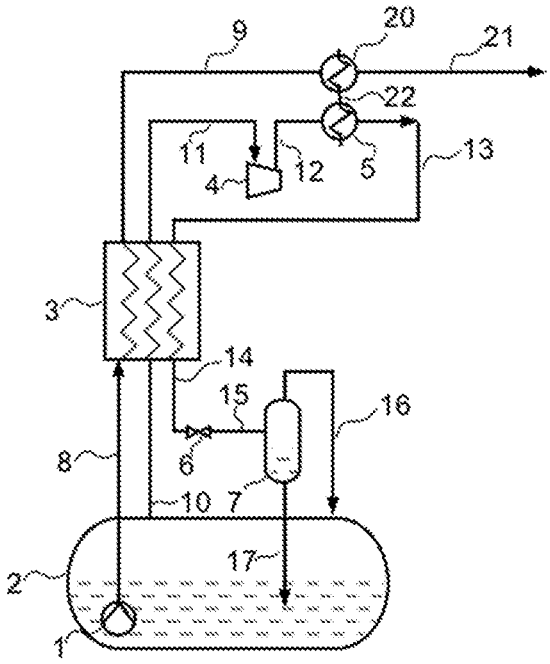
FIG. 4 is a schematic configuration showing the details of the integration of compressor after cooling water with fuel gas trim heater in accordance with another embodiment of the present invention.

Referring now to FIG. 4, it shows the details of the integration of compressor after cooler with fuel gas trim heater in accordance with another embodiment of the present invention. The reliquefaction system can have enhanced energy and utility supply efficiency by using the discharge cooling medium from the compressor after cooler 5 for the vaporizer 20. As shown in FIG. 4, stream 22 is the hot medium at the discharge of the compressor after cooler 5, entering the vaporizer 20 as heating medium. The other streams and equipment in FIG. 4 are to operate in the same conditions and manner as described in their identical streams and equipment in FIGS. 1-3.

Figure 5:
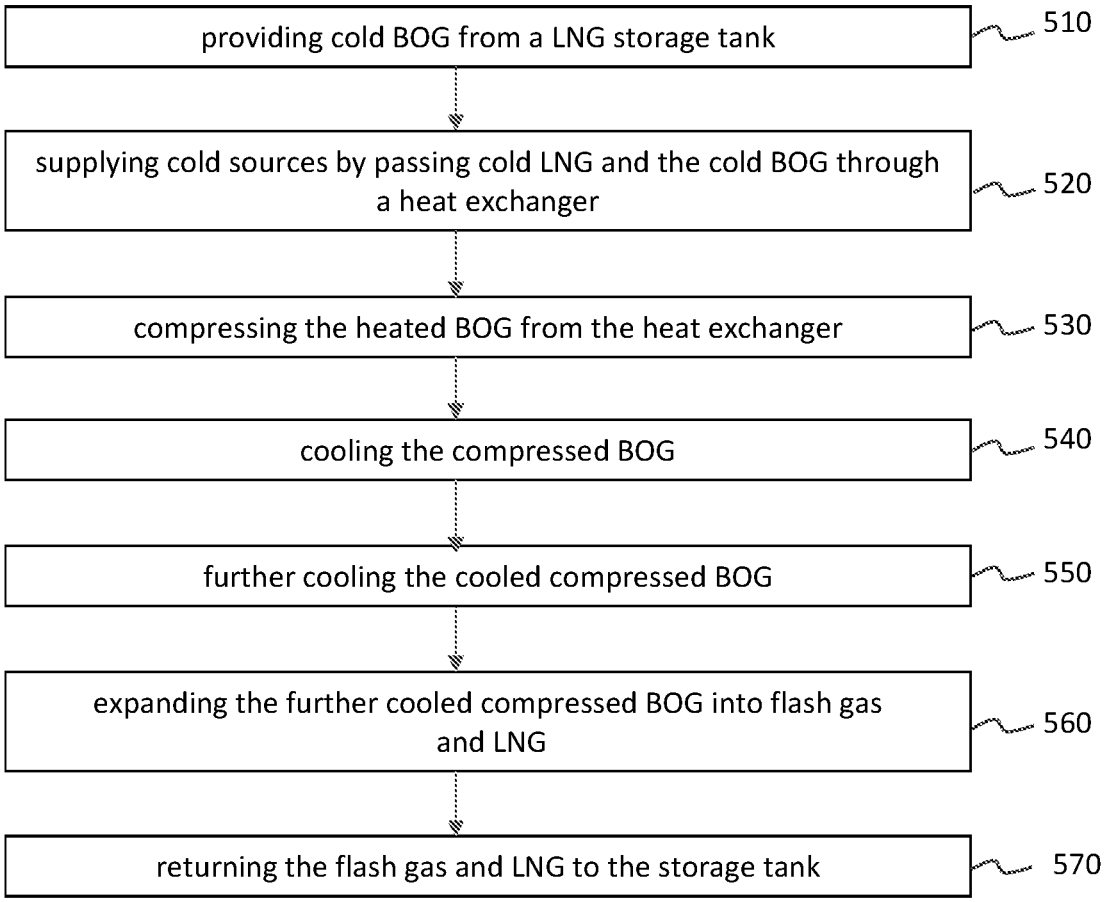
FIG. 5 is a flow chart showing the BOG reliquefaction process in accordance with one embodiment of the present invention.

Referring now to FIG. 5, there is provided a process of reliquefaction of LNG boil-off gas (BOG) in accordance with one embodiment of the present invention. The process 500 comprises:

providing 510 cold BOG from a LNG storage tank, wherein the cold BOG is at close to atmospheric pressure and −160° C.;

supplying 520 cold sources by passing cold LNG and the cold BOG through a heat exchanger, where the cold LNG is at close to atmospheric pressure and −160° C. and from the LNG storage tank, and where the cold BOG is heated in the heat exchanger to room temperature, and the LNG is vaporized in the process;

compressing 530 the heated BOG from the heat exchanger to a pressure ranges from 30 to 300 barg, preferably close to 50 barg for optimal efficiency and cost effectiveness in material and equipment selection, where the compressed BOG is discharged with temperature of 100 to 150° C.;

cooling 540 the compressed BOG to remove heat from the compressed BOG, resulting in a cooled compressed BOG at a temperature ranging from 20° C. to 45° C.;

further cooling 550 the cooled compressed BOG to a temperature ranging from −130° C. to −155° C., preferably around −150° C.;

expanding 560 the further cooled compressed BOG into flash gas and LNG close to atmospheric pressure and −160° C.; and returning 570 the flash gas and LNG to the storage tank.

In the reliquefaction process of the present invention, there is no external refrigerant such as nitrogen to generate cold energy utilizing close loop refrigeration cycle. Also, there is no refrigerant compressors, expanders or pulse tube refrigerators utilized in the process of the present invention. Essentially this is the most compact, least complex, lowest energy consumption and low cost solution, which integrates two separate systems; fuel gas supply system and reliquefaction system into one module. Total electrical consumption for the present invention is less than 50% of conventional reliquefaction systems.

While preferred embodiments of the present subject matter have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A boil-off gas (BOG) reliquefaction system comprising:

an in-tank fuel pump 1;

a LNG storage tank 2;

a heat exchanger 3;

a multistage compressor 4;

a compressor after cooler 5;

an expansion valve 6; and a LNG flash drum 7;

wherein the in-tank fuel pump 1 is disposed inside the LNG storage tank 2 for drawing LNG from the LNG storage tank 2;

wherein the heat exchanger 3 is fluidly coupled with the in-tank fuel pump 1 for receiving the LNG from the in-tank pump 1 and coupled with the storage tank 2 to receive BOG from the storage tank 2; wherein the LNG is vaporized, and the vaporized LNG and the BOG provide cold sources, resulting in cold energy recovered BOG;

wherein the inlet of the multistage compressor 4 is coupled to the heat exchanger 3 to receive the cold energy recovered BOG, and the outlet of the multistage compressor 4 to the inlet of the compressor after cooler 5; wherein the cold energy recovered BOG is compressed; and wherein the compressor after cooler 5 removes heat from the compressed BOG;

wherein the outlet of the compressor after cooler 5 is coupled with the heat exchanger 3; and wherein the compressor after cooler 5 discharges the compressed and after cooled BOG to the heat exchanger 3 at a temperature ranging from 20° C. to 45° C.;

wherein inside the heat exchanger, the compressed and after cooled BOG is cooled down further by the cold sources from the vaporized LNG and BOG;

wherein the inlet of the expansion valve 6 is coupled with the heat exchanger 3 to receive the cryogenically cooled compressed BOG;

wherein the outlet of the expansion valve 6 is coupled with the flash drum 7; wherein the cold compressed BOG is expanded via the expansion valve 6, resulting in the expanded BOG that is close to atmospheric pressure; and wherein the flash drum 7 receives the expanded BOG, and returns flash gas and LNG recovered to the LNG storage tank 2.

2. The BOG reliquefaction system of claim 1, wherein the BOG is compressed in the multistage compressor 4 to a pressure ranges from 30 to 300 barg.

3. The BOG reliquefaction system of claim 1, wherein the resultant cold compressed BOG leaves the heat exchanger at a temperature ranges from −130° C. to −155° C., preferably around −150° C.

4. The BOG reliquefaction system of claim 1, further comprising a LNG booster pump 18, wherein the LNG booster pump 18 is disposed between the LNG storage tank 2 and the heat exchanger 3, and increases the pressure of the LNG to supply high-pressure fuel gas.

5. The BOG reliquefaction system of claim 1, further comprising an additional vaporizer 20, wherein the vaporizer 20 is disposed downstream of the heat exchanger 3.

6. The BOG reliquefaction system of claim 5, wherein the discharge cooling medium from the compressor after cooler 5 is used to heat the vaporizer 20.

7. The BOG reliquefaction system of claim 1, wherein the expansion valve 6 is a Joule Thomson (JT) valve.

* * * * *